US006712930B2

(12) United States Patent
Koivukunnas

(10) Patent No.: US 6,712,930 B2
(45) Date of Patent: Mar. 30, 2004

(54) METHOD FOR CALENDERING TISSUE PAPER

(75) Inventor: Pekka Koivukunnas, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/332,187

(22) PCT Filed: Jul. 5, 2001

(86) PCT No.: PCT/FI01/00643

§ 371 (c)(1),
(2), (4) Date: May 6, 2003

(87) PCT Pub. No.: WO02/04743

PCT Pub. Date: Jan. 17, 2002

(65) Prior Publication Data

US 2003/0173043 A1 Sep. 18, 2003

(30) Foreign Application Priority Data

Jul. 10, 2000 (FI) ..... 20001637

(51) Int. Cl.[7] ..... D21G 1/00; B31F 1/16

(52) U.S. Cl. ..... 162/117; 162/205; 162/111; 162/206; 100/38

(58) Field of Search ..... 162/204–207, 162/109, 111–113, 117, 123; 100/35, 38, 41, 37

(56) References Cited

U.S. PATENT DOCUMENTS

| | | | | | |
|---|---|---|---|---|---|
| 2,021,975 | A | | 11/1935 | Wrigley et al. | |
| 2,624,245 | A | | 1/1953 | Cluett | |
| 2,667,910 | A | | 2/1954 | Grettve | |
| 2,997,406 | A | | 8/1961 | Freeman et al. | |
| 3,148,108 | A | * | 9/1964 | Cluett | 162/155 |
| 3,266,972 | A | * | 8/1966 | Cramer et al. | 162/146 |
| 3,329,562 | A | * | 7/1967 | Schaefer | 162/361 |
| 3,515,633 | A | * | 6/1970 | Futch, Jr. | 162/206 |
| 3,908,071 | A | * | 9/1975 | Heim et al. | 428/323 |
| 4,701,368 | A | | 10/1987 | Kiuchi et al. | |
| 4,908,103 | A | | 3/1990 | Cronin et al. | |
| 5,163,364 | A | | 11/1992 | Bubik et al. | |
| 5,251,551 | A | | 10/1993 | Abe et al. | |
| 5,352,022 | A | * | 10/1994 | Knoblock | 297/452.15 |
| 5,400,707 | A | | 3/1995 | Neider et al. | |
| 5,694,837 | A | * | 12/1997 | Neider et al. | 100/327 |
| 5,830,321 | A | * | 11/1998 | Lindsay et al. | 162/204 |
| 5,836,242 | A | | 11/1998 | Aberg | |
| 5,980,691 | A | | 11/1999 | Weisman et al. | |
| 6,076,281 | A | * | 6/2000 | Kilpia et al. | 34/457 |
| 6,077,390 | A | | 6/2000 | Salman et al. | |
| 6,103,062 | A | * | 8/2000 | Ampulski et al. | 162/109 |
| 6,158,334 | A | | 12/2000 | Sáfman et al. | |
| 6,193,839 | B1 | * | 2/2001 | Ampulski et al. | 162/117 |
| 6,287,424 | B1 | * | 9/2001 | Mohan et al. | 162/206 |
| 6,287,426 | B1 | * | 9/2001 | Edwards et al. | 162/281 |
| 6,332,953 | B1 | * | 12/2001 | Singh et al. | 162/134 |
| 6,397,739 | B1 | * | 6/2002 | Viljanmaa | 100/38 |
| 6,418,840 | B1 | * | 7/2002 | Viljanmaa | 100/38 |
| 6,440,268 | B1 | * | 8/2002 | Baggot et al. | 162/118 |
| 6,551,453 | B2 | * | 4/2003 | Weisman et al. | 162/117 |
| 6,598,521 | B2 | | 7/2003 | Wikström | |

FOREIGN PATENT DOCUMENTS

| | | |
|---|---|---|
| CA | 2236829 | 12/1998 |
| DE | 299 02 451 | 7/1999 |
| WO | WO 99/23305 | 4/1999 |
| WO | WO 02/04743 | 1/2002 |

OTHER PUBLICATIONS

Search Report issued in Finnish Priority Application No. 20001637.
International Search Report issued in International Application No. PCT/FI01/00643.
International Preliminary Examination Report issued in International Application No. PCT/FI01/00643.
"OptiDwell shoe nip calender" Metso Paper, Inc. Brochure.
"Metso Paper Calenders, Järvenpää, Finland 2002" cover sheet and pp. 24 and 30.

* cited by examiner

*Primary Examiner*—José A. Fortuna
(74) *Attorney, Agent, or Firm*—Stiennon & Stiennon

(57) ABSTRACT

Tissue paper is calendered in at least one calendering nip. The tissue paper is calendered in at least one soft, long calendering nip. By belt calendering a high crêping effect is achieved when a so-called post-nip contact is used. With post-nip contact, the web and the belt are in contact with the thermo roll over a distance of 10–200 mm after the nip, whereby the belt tension presses the web against the surface of the thermo roll, and hereby the belt expands in the nip, and when it is then restored it will crêpe the paper. In this manner a soft tissue paper with maximum bulkiness is brought about. The belt tension used in the belt calender is 1–10 kN/m.

4 Claims, No Drawings

METHOD FOR CALENDERING TISSUE PAPER

CROSS REFERENCES TO RELATED APPLICATIONS

This application is a U.S. national stage application of International Application No. PCT/FI01/00643, filed Jul. 5, 2001, and claims priority on Finnish Application No. 20001637, filed Jul. 10, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to methods for calendering tissue paper in general, and more particularly to tissue paper calendering methods involving at least one long belt calendering nip.

Tissue papers contain various sub-grades of silk and tissue papers, such as toilet papers, facial tissues, handkerchief tissues, napkin tissues and wipe-off papers, including e.g. industrial towels, towel papers for use in the kitchen and other towel papers. As is known in the state of the art, tissue papers are conventionally calendered in calendars with a hard nip. The main purpose of calendering is to control the CD (cross direction) thickness. Calendering is performed at very low loads and at a low temperature. In tissue making, calenders are also used in order to bring together the various layers of multi-layer tissue papers before rolling. In connection with the manufacture of some tissue paper grades it has been known to use soft calendering in the calendering of tissue paper, whereby the calendering takes place in a calendering nip, where at least one roll is a so-called soft roll.

U.S. Pat. No. 5,980,691 presents a soft tissue paper with a high density and a method for its manufacture. This publication makes known calendering of a tissue paper web in the calendering nip in such a way that a tissue paper is obtained, the evenness or uniformity of which is less than or equal to 800 microns. In this publication, such a calendering nip is used in the calendering, wherein one roll or both rolls are of steel, surface-coated with rubber, fabric or paper. One roll or both rolls are kept at a temperature, which is optimum for the useful life of the roll in order to prevent overheating of the roll.

As regards the state of the art relating to the invention, reference is also made to Patent Publication WO-9923305, which presents a belt calender, wherein the nip is formed in between the belt and the roll. The belt material used in belt calenders is usually considerably softer than the surface material of soft rolls used in soft calenders.

As is known, the belt material of belt calenders is about ten times softer than the softest surface-coatings of rolls, and it is known in the state of the art that by soft calendering it is possible to achieve significant advantages compared with hard-nip calendering, which is the most commonly used method at present. It is also known that with some paper and board grades the belt calendering concept gives significant advantages in the paper quality compared with soft calendering than soft calendering gives compared with hard-nip calendering. One of the major advantages with board grades is the saving in bulk, since the treatment is very soft and low pressures are used.

SUMMARY OF THE INVENTION

The invention aims at bringing about a new method for calendering of tissue paper, with which maximum bulkiness and softness of the tissue paper are achieved.

BRIEF DESCRIPTION OF THE DRAWINGS

Not applicable.

DESCRIPTION OF THE PREFERRED EMBODIMENTS

According to the invention, by using a belt calender maximum bulkiness and softness are achieved in tissue paper calendering.

One basic factor of the invention is that by belt calendering a high crêping effect is achieved when a so-called post-nip contact is used. This means that the web and the belt are in contact with the thermo roll over a distance of 10–200 mm after the nip, whereby the belt tension will press the web against the surface of the thermo roll, and hereby the belt expands in the nip, and when it is then restored it will crêpe the paper. In this manner a soft tissue paper with maximum bulkiness is brought about. The belt tension used in the belt calender is 1–10 kN/m.

Calendering parameters preferably used in connection with the invention are e.g. a pressure of 5 MPa and a nip length of 20–500 mm.

In the method according to the invention, it is easier to control low pressures than in traditional solutions, because a long calendering nip is used. According to the invention, very low calendering pressures are preferably used in the calendering of tissue paper, which makes for added softness and bulkiness.

In the method according to the invention, such a long nip is used in tissue paper calendering, which is achieved by using a belt calender or a shoe calender, whereby the nip length is 20–500 mm, preferably 25–275 mm. According to the invention, the belt material is also soft and its hardness is 80–100 ShA.

What is claimed is:

1. A method for calendering tissue paper comprising the steps of:

passing a tissue paper web through a calender nip formed between a roll which compress a calender belt having a hardness of 80 to 100 ShA against a thermo roll, wherein the pressure in the nip expands the calender belt; and keeping the tissue paper web backed by the calender belt in contact with the thermo roll over a distance of 10–200 mm after the nip, with a tension in the calender belt of 1–10 kN/m whereby the calender belt tension presses the web against the surface of the thermo roll, and thereby the calender belt contracts after passing the nip, and crêping the tissue paper with the contracting calender belt.

2. The method of claim 1 wherein the tissue paper is subjected to a pressure of about 5.0 Mpa in the calender nip.

3. The method of claim 1 wherein the tension in the calender belt is between 5–7 kN/m.

4. The method of claim 1 wherein the thermo roll has a temperature of less than 150° C.

* * * * *